US009247840B2

(12) United States Patent
Diamond et al.

(10) Patent No.: US 9,247,840 B2
(45) Date of Patent: Feb. 2, 2016

(54) ROLLER BLIND WITH INSTALLATION FRAME

(75) Inventors: Cormac Diamond, Draperstown L/Derry (GB); Kevin McCullagh, Draperstown L/Derry (GB)

(73) Assignee: FOURDS LIMITED, Draperstown (GB)

( * ) Notice: Subject to any disclaimer, the term of this patent is extended or adjusted under 35 U.S.C. 154(b) by 104 days.

(21) Appl. No.: 13/993,168

(22) PCT Filed: Dec. 12, 2011

(86) PCT No.: PCT/EP2011/072486

§ 371 (c)(1),
(2), (4) Date: Aug. 22, 2013

(87) PCT Pub. No.: WO2012/080189

PCT Pub. Date: Jun. 21, 2012

(65) Prior Publication Data

US 2014/0000820 A1 Jan. 2, 2014

(30) Foreign Application Priority Data

Dec. 13, 2010 (GB) ..... 1021041.7

(51) Int. Cl.
*E06B 9/40* (2006.01)
*A47H 1/13* (2006.01)
(Continued)

(52) U.S. Cl.
CPC .. *A47H 1/13* (2013.01); *E06B 9/42* (2013.01); *E06B 9/58* (2013.01); *E06B 9/582* (2013.01); *E06B 9/60* (2013.01); *E06B 2009/805* (2013.01)

(58) Field of Classification Search
CPC ..... E06B 9/40; E06B 9/56
USPC ..... 160/31, 239, 267.1, 275, 277, 278, 160/290.1
See application file for complete search history.

(56) References Cited

U.S. PATENT DOCUMENTS 1,745,208 A * 1/1930 Dixson ..... 160/31
2,325,992 A * 8/1943 Wirthman ..... 160/29
(Continued)

FOREIGN PATENT DOCUMENTS

EP 2199529 A2 12/2009
WO 9907974 A1 2/1999

OTHER PUBLICATIONS

PCT International Search Report for Application No. PCT/EP2011/072486 filed on Dec. 12, 2011 and is a counterpart of U.S. Appl. No. 13/993,168.
(Continued)

*Primary Examiner* — Katherine Mitchell
*Assistant Examiner* — Abe Massad
(74) *Attorney, Agent, or Firm* — Warner Norcross & Judd LLP

(57) ABSTRACT

A screen assembly for a window comprising a screen supported by an elongate support member adapted to be mounted in an upper region of the window opening, a pair of mounting brackets being provided for attachment to respective sides of the window opening adjacent the top face of the window opening, each end of the elongate support member having means for engaging a respective mounting bracket, whereby the mounting brackets may be attached the sides of a window opening such that the support member may be engaged onto the mounting brackets to mount the support member in the window opening.

39 Claims, 15 Drawing Sheets

(51) Int. Cl.

| | |
|---|---|
| ***E06B 9/42*** | (2006.01) |
| ***E06B 9/58*** | (2006.01) |
| *E06B 9/60* | (2006.01) |
| *E06B 9/80* | (2006.01) |

(56) References Cited

U.S. PATENT DOCUMENTS

| | | | | |
|---|---|---|---|---|
| 2,383,015 | A * | 8/1945 | Pratt | 160/267.1 |
| 4,035,093 | A * | 7/1977 | Redshaw | 403/4 |
| 4,140,294 | A * | 2/1979 | Zwarts | 248/265 |
| 4,307,551 | A * | 12/1981 | Crandell | 52/235 |
| 4,658,879 | A * | 4/1987 | Van Klompenburg | 160/271 |
| 5,088,543 | A * | 2/1992 | Bilbrey | 160/310 |
| 6,666,251 | B2 * | 12/2003 | Ikle | 160/120 |
| 6,701,994 | B2 * | 3/2004 | Goldenberg et al. | 160/31 |
| 7,478,508 | B2 * | 1/2009 | Peterson | 52/573.1 |
| 7,617,567 | B2 * | 11/2009 | Franchini | 16/236 |
| 2006/0000559 | A1 * | 1/2006 | Bohlen | 160/31 |
| 2007/0284053 | A1 * | 12/2007 | Mullet et al. | 160/31 |
| 2008/0283204 | A1 * | 11/2008 | Beck et al. | 160/239 |
| 2009/0127369 | A1 * | 5/2009 | Mullet et al. | 242/379 |
| 2009/0277594 | A1 * | 11/2009 | Stewart et al. | 160/311 |
| 2014/0250804 | A1 * | 9/2014 | Kuperus et al. | 52/173.1 |

OTHER PUBLICATIONS

PCT International Written Opinion for Application No. PCT/EP2011/072486 filed on Dec. 12, 2011 and is a counterpart of U.S. Appl. No. 13/993,168.

* cited by examiner

ROLLER BLIND WITH INSTALLATION FRAME

FIELD OF THE INVENTION

This invention relates to screen assembly for a window, and in particular to a screen assembly for a window that can be easily fitted and which can reliably shut out light through the window when the screen is closed.

BACKGROUND OF THE INVENTION

Windows are typically provided with screen assemblies fitted to the inside of the frame of the window opening, typically fixed to the upper face of the window opening or between the sides of the window opening adjacent the upper face thereof, for selectively obscuring the window. In the case of a roller blind, such screen assemblies typically have a roller mounted at an upper side of the frame around which a suitable screen is wound. The screen may be lowered and raised by rotating the roller. The lower end of the screen may be provided with a bar such that the screen hangs from the roller under gravity.

A problem with such known screen assemblies is that the width of the roller must be accurately matched to the width of the window opening to enable the screen assembly to be mounted within the window opening. Furthermore, gaps between the sides of the screen and the sides of the window opening prevent the screen from completely shutting out light when the screen is closed.

SUMMARY OF THE INVENTION

According to a first aspect of the present invention there is provided a screen assembly for a window comprising a screen supported by an elongate support member adapted to be mounted in an upper region of the window opening, a pair of mounting brackets being provided for attachment to respective sides of the window opening adjacent the top face of the window opening, each end of the elongate support member having an engaging device for engaging a respective mounting bracket, whereby the mounting brackets may be attached the sides of the window opening such that the support member may be engaged onto the mounting brackets to mount the support member in the window opening, wherein each mounting bracket comprises a first part attachable to a respective side of the window opening and a second part adapted to be mounted on the first part, said second part being adapted to engage a respective end of the elongate support member, wherein said second part of each mounting bracket is adapted to be mounted on the respective first part in a plurality of positions to enable the relative position of the second part of each mounting bracket to be adjusted with respective to the first part, in use, in a substantially vertical direction.

Preferably the elongate support member is provided with a flange adapted to be located against an outer face of the window opening to obscure any gap existing between the support member and the window opening. Preferably said flange extends along an upper side of the elongate support member to obscure any gap between the upper side of the elongate support member and the upper side of the window opening. Preferably said flange is substantially contiguous with a front face of the elongate support member.

Preferably said engaging device on each end of the elongate support member comprises a recess for receiving a body portion of a respective bracket such that the elongate support member may be engaged over the mounting brackets to retain the support member between the sides of the window opening.

Preferably the elongate support member is secured on the mounting brackets by the insertion of a fastening device, such as a screw or nail, through support member into the respective bracket, preferably through mounting apertures provided in a lower face of the support member. A receiving aperture may be formed in each side of the support member for guiding the fastening device into the respective bracket. The receiving aperture may be inclined to the vertical to assist insertion of the respective fastening device.

The screen may comprise a plurality of vertically or horizontally spaced louvres, vanes or planar strips. In a preferred embodiment the screen comprises a roller blind defined by a sheet of fabric or similar flexible material wound onto on roller, said roller being mounted on or within said elongate support member. The roller may be tensioned, for example by means of a spring, to bias the roller in a winding direction whereby the screen is biased towards a raised or open position.

Preferably the screen is moveable between a pair of spaced guide tracks adapted to be mounted on each side of the window opening, a handle assembly being mounted on a free end of the screen between said guide tracks.

Preferably each guide track is provided with a flange defining an extension of a front face of the guide track to extend over an outer face of window opening to close any gap between the sides of the window opening and the guide tracks. Preferably said flange is substantially contiguous with the front face of the guide track. Preferably the flange is integral with the front face of the guide track.

The provision of flanges on the support member and/or the guide tracks enables the blind assembly to be fitted within the window opening flush to the face of the wall surrounding the window opening, thus providing a light-proof seal between the blind assembly and the window opening and compensating for any dimensional irregularities in the window opening.

A resilient sealing device, preferably defined by an elongate strip of resilient material, may be provided between abutting faces of the elongate support member and the window opening and/or between the guide tracks and the support opening.

Foam strips, fibre brushes or similar sealing devices may be mounted on an inner face of each guide track to create a draft and light-proof seal against a face of the screen. A similar sealing device may be provided between an inner face of the support member and the roller.

Preferably a locking device is mounted on each end of the handle assembly, each locking device being moveable between a locking position, wherein the locking device engages a respective one of the guide tracks to prevent movement of the screen, and an unlocked position, wherein the screen is free to move with respect to the guide tracks, said locking devices being biased towards their locked positions by the action of the tensioned screen on the handle and being moveable towards their unlocked position, against said biasing force of the tensioned screen, by operation of the handle assembly.

The ability of the handle to be locked in any desired position enables the handle to be tightly engaged against the window sill to form a lightproof seal against the sill. A resilient seal may be provided on a lower side of the handle to engage the sill when the screen is in a fully closed position.

Preferably each locking device is connected to a respective end of the handle assembly by a connection device permitting limited movement of the respective locking device with respect to the handle assembly to accommodate misalignment between the locking devices and the guide tracks, as disclosed in European Patent Application EP 2199529, which is incorporated herein by reference.

Thus the locking devices can freely move along the guide track while the handle is being pulled against the tension of the roller and are automatically returned to their locking positions by the tension applied to the screen by the roller once the handle is released.

Preferably said locking devices are rotatable between their respective locking and unlocked positions about an axis extending transversely of the screen, each respective connection device being adapted to permit limited rotational movement of the respective locking device with respect to the handle.

In one embodiment, each guide track comprises an elongate rail, each locking device comprises first and second parts located opposite sides of the rail such that rotation of the locking device brings said first and second parts of the locking device into engagement with either side of the rail to grip the rail. Alternatively each guide track comprises a pair of parallel rails, each locking device being located between the parallel rails of a respective guide track, each locking device having an elliptical or elongated shape having a length greater than the width of the track.

Preferably the handle assembly is mounted for pivotal movement about said rotational axis of the locking devices with respect to the guide tracks between a first position wherein the locking devices are in their locking positions and a second position wherein the locking devices are in their unlocked position, the handle being arranged such that the handle is pivoted towards its first position under the action of the tensioned screen whereby the locking devices engage the guide tracks to automatically lock the screen in a desired position when the handle is released by a user.

The guide tracks may be provided with a positive locking device to positively lock the screen in a fully closed position. In one embodiment the positive locking device comprises a projection, catch or pawl provided on each guide track, each locking device of the handle having a corresponding projection, catch or pawl arranged to engage the respective projection, catch or pawl of the respective guide track to positively lock the screen in its lowermost fully closed position. The positive locking device is preferably arranged such that each projection, catch or pawl of the handle is biased into engagement with the respective corresponding projection, catch or pawl of the guide track as the handle is pivoted towards its first portion under the action of the tensioned screen. In a preferred embodiment the positive locking device comprises a ramped latch provided on a face of each guide track and a cooperating pawl provided on each locking device of the handle for engaging the latch to lock the screen in a fully closed or lowered position, preferably wherein the handle engages the sill of the window opening.

Each mounting bracket may be provided with a laterally extending tab or wing extending from the upper side of the mounting bracket to enable the spacing between the mounting bracket and the upper face of the window opening to be set by abutting the tab or wing against the upper face of the window opening.

Each mounting bracket may be securable to a respective side of the window opening by means of one or more nails or similar fasteners and/or by means of an adhesive. One or more apertures may be provided in each mounting bracket for receiving said fasteners.

BRIEF DESCRIPTION OF THE DRAWINGS

An embodiment of the present invention will now be described, by way of example only, with reference to the accompanying drawings, in which:—

DETAILED DESCRIPTION OF THE DRAWINGS

Figure 1:
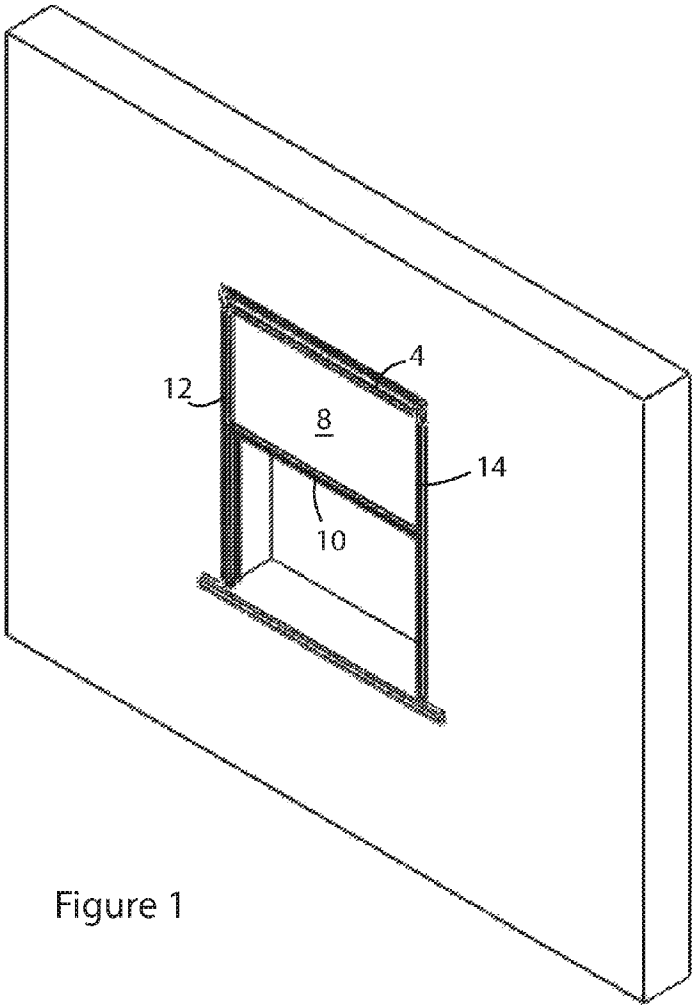
FIG. 1 is a perspective view of a window provided with a screen assembly according to an embodiment of the present invention.
Figure 2:
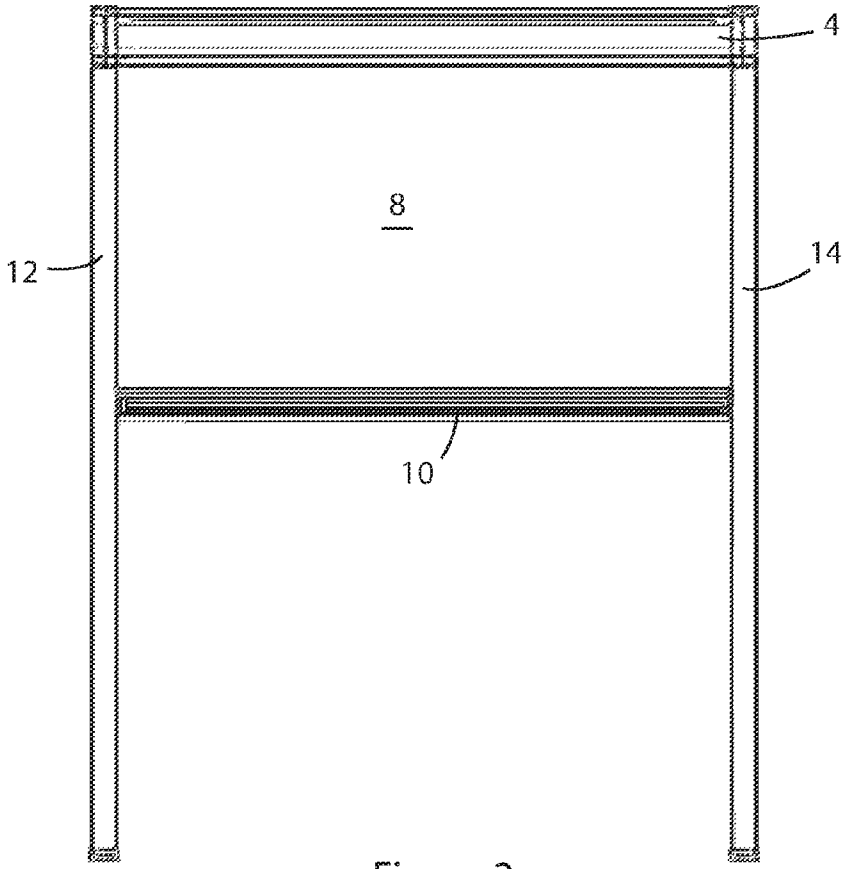
FIG. 2 is a front view of the screen assembly of FIG. 1.

As shown in FIG. 1, a screen assembly for a window comprises a spring tensioned roller 2 mounted within a support beam 4 defining an elongate hollow cassette 6 secured in an upper side of the window frame, around which a screen 8 is wound. A free end of the screen 8 is attached to an elongate handle 10 which is movably engaged, at its longitudinal ends, in side guide tracks 12,14 arranged on opposite lateral sides of the screen 8.

The support beam 4 mounted between the sides of the window opening adjacent the upper face of the window opening by means of a pair of mounting brackets 16,18.

The support member 4 is provided with an integrally formed flange 36 defining an extension of the front face of the support member 4 to overlap the wall adjacent the upper face of the window opening such that the support member fits against the window opening substantially flush with the wall, the flange covering any gap between the support member 4 and the window opening, for example due to dimensional inaccuracies of the window opening.

Similarly, the guide tracks 12,14 are provided with laterally extending flanges 38,40 contiguous with the front faces of the guide tracks 12,14 to overlap the wall adjacent the sides of the window opening to cover any gaps between the sides of the guide tracks 12,14 and the sides of the window opening.

Figure 4:
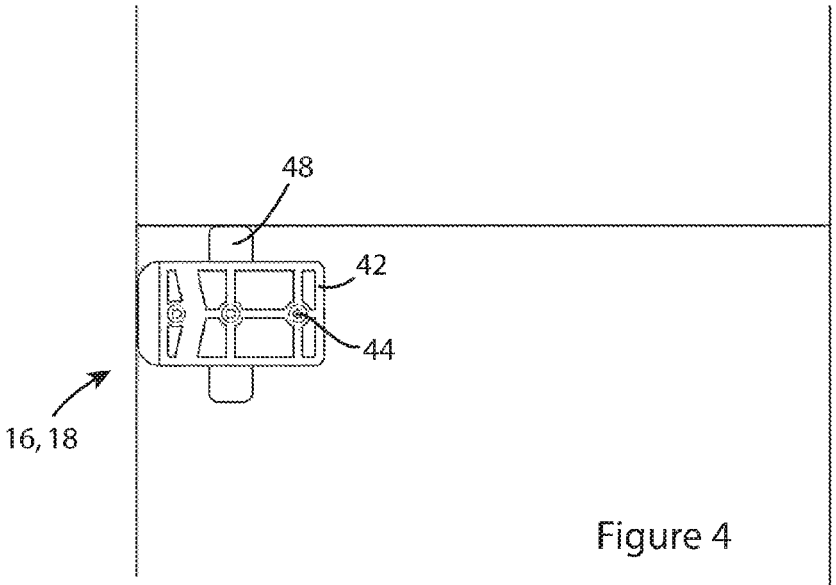
FIG. 4 is a detailed view of a mounting bracket of the screen assembly of FIG. 1.
Figure 5:
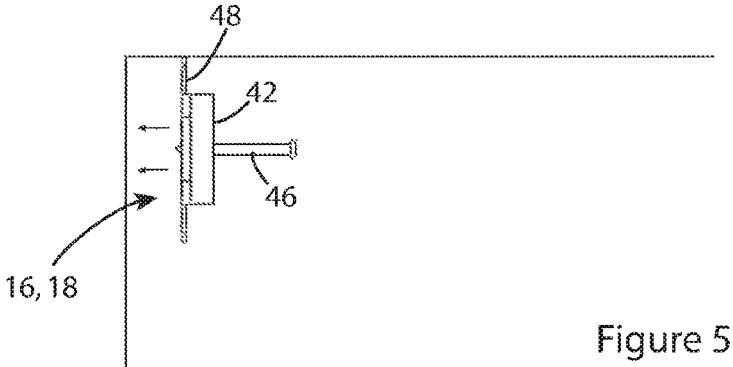
FIG. 5 is a detailed view showing the fitting of a mounting bracket of the screen assembly of FIG. 1.
Figure 6:
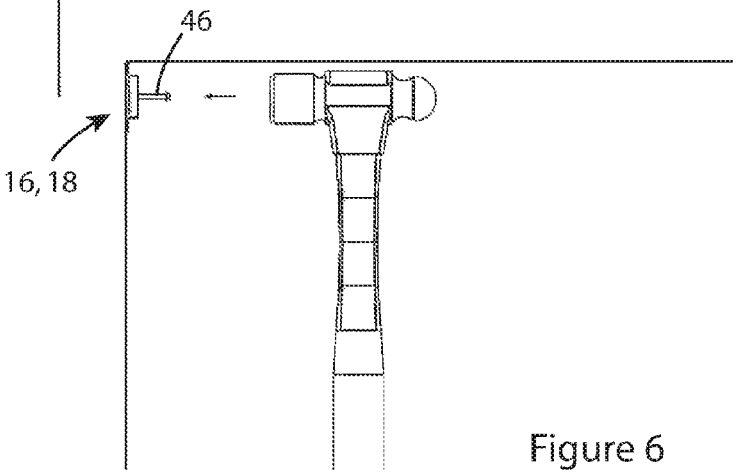
FIG. 6 is a further detailed view showing the fitting of the mounting bracket of FIG. 5.
Figure 7:
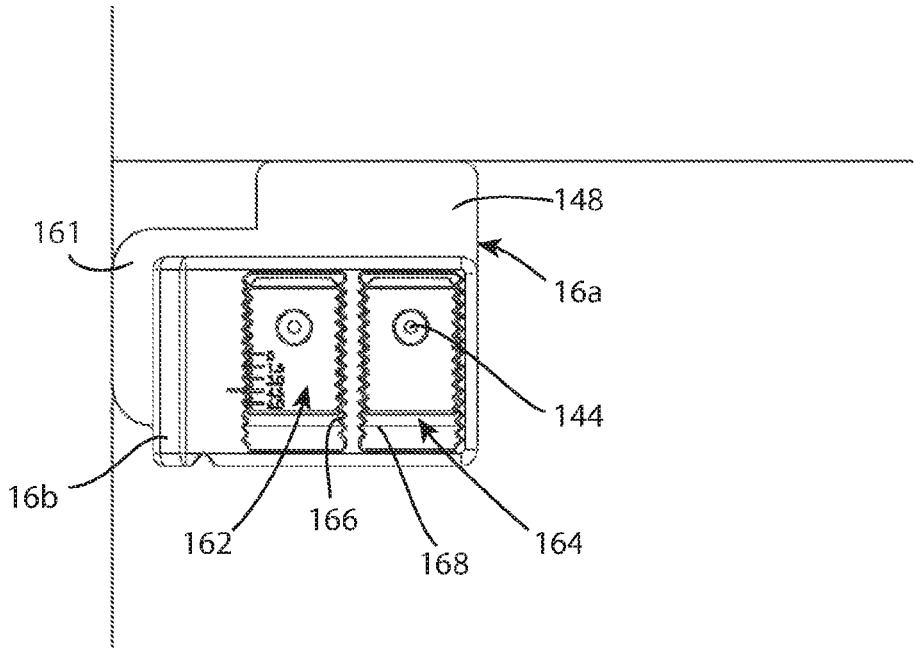
FIGS. 7 to 10 show a detailed view of a modified mounting bracket for use with the screen assembly of FIG. 1.
Figure 8:
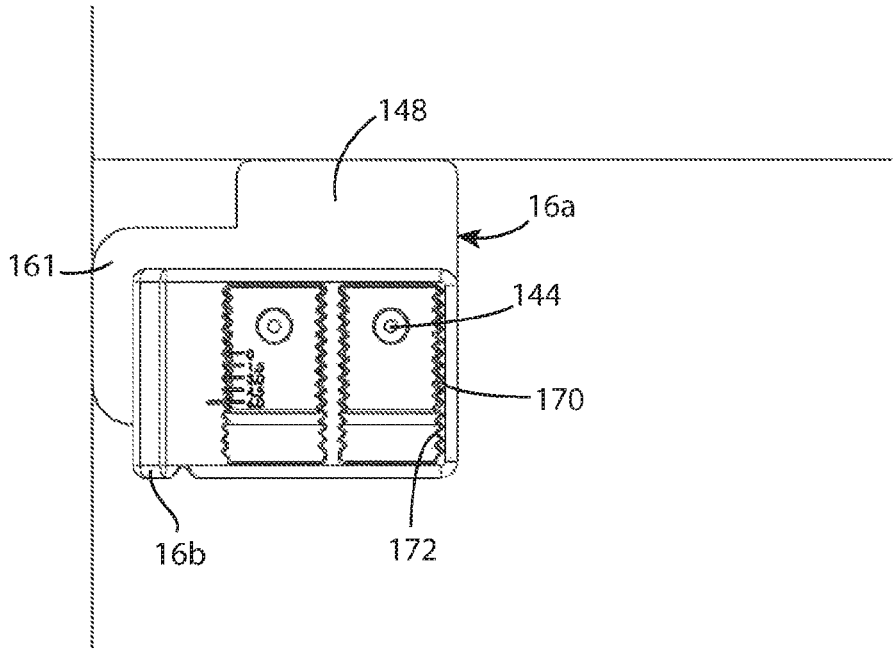

The mounting brackets 16,18 enable the screen assembly to be easily and quickly fitted into a window opening. As shown in FIG. 4, each mounting bracket 16,18 comprises a rectangular body 42 having three spaced mounting apertures 44 through which nails 46 may be inserted to secure each bracket to a side face of the window opening. Each bracket 16,18 is provided with transverse tabs or wings 48 which can be used to set the position of each bracket 16,18 on the sides of the window opening, the length of the tabs or wings 48 being adapted to provide the correct spacing of the brackets 16,18 from the upper face of the window opening when the tabs or wings 48 are abutted against the upper face of the window opening.

Each end of the support beam 4 is provided with a recess 50 to be fitted over a respective bracket 16,18 to locate the support beam 4 between the sides of the window opening.

Figure 9:
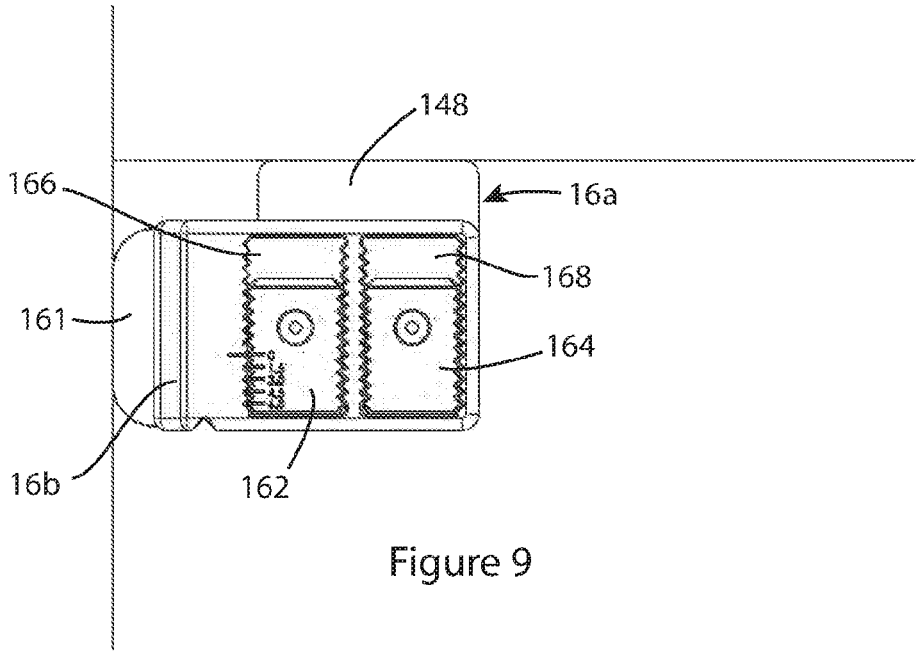
Figure 10:
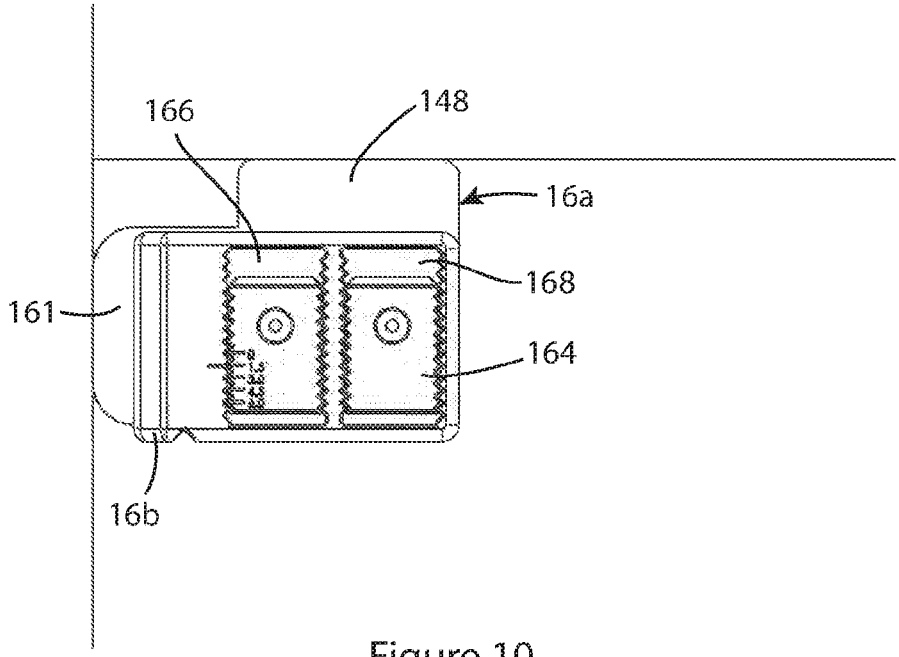
Figure 11:
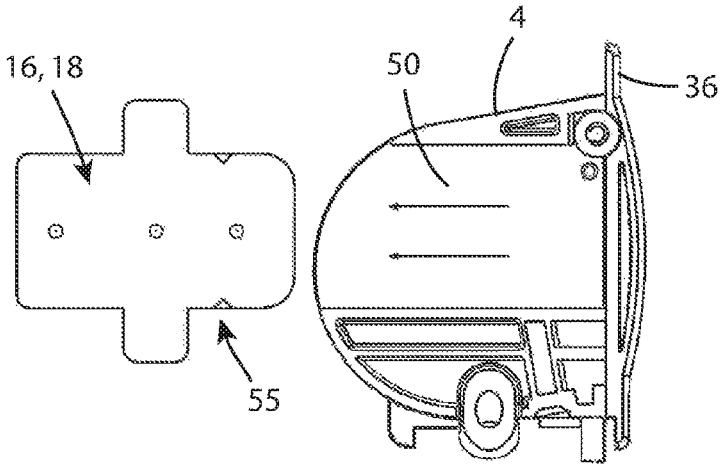
FIG. 11 is a detailed view showing the fitting of the cassette to the mounting bracket.
Figure 12:
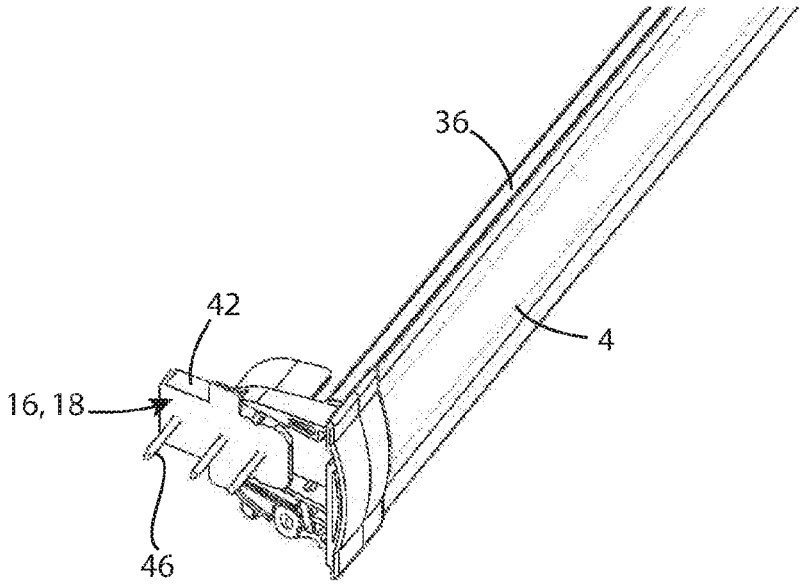
FIG. 12 is a perspective view showing the fitting of the cassette onto the mounting brackets.
Figure 13:
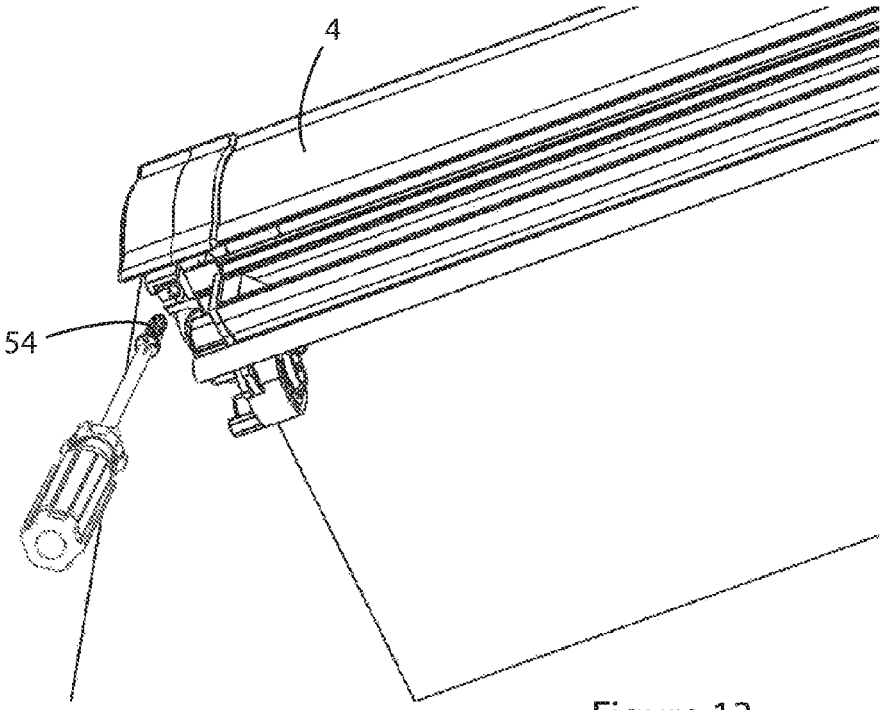
FIGS. 13 and 14 show the installation of a screw to secure the cassette to the mounting bracket.

In use, the mounting brackets 16,18 are secured to the sides of the window opening and the support beam 4 is locates over the brackets 16,18 such that the brackets 16,18 slide into the recesses 50 at each end of the support beam 4. The support beam 4 is pushed over the brackets 16,18 until the flange 36 on the front face of the support beam 4 abuts the front face of the head of the window opening. The support beam 4 is provided with apertures 52 in the lower face of the support beam in the region of each recess 50 through which fasteners, such as self tapping screws 54, can be inserted to extend into the body 42 of each bracket 16,18 to secure the support beam 4 to the brackets 16,18, as shown in FIGS. 9 and 10. The apertures 52 are inclined to the vertical to assist insertion of the screws into the brackets 16,18 by providing better access for a screwdriver. Receiving apertures 55 may be provided in the mounting brackets 16,18 for receiving the screws 54.

A modified mounting bracket is illustrated in FIGS. 7 to 10, wherein the mounting bracket is formed from two parts 16*a*, 16*b*, a first part 16*a* being mountable on a respective side of the window opening and a second part 16*b*, mountable upon the first part, upon which an end of the support beam 4 can be mounted, the first and second part 16*a*,16*b* being adapted to be vertically adjustable with respect to one another to allow the brackets to be adjusted to take account of any misalignment of the brackets, for example due to the window opening not being completely square.

The first part 16*a* of each mounting bracket comprises a relatively thin planar base part 161 having an upper tab or wing 148 arranged to abut an upper corner of the window opening to locate the first part 16*a* of the mounting bracket against the window opening. A pair of substantially rectangular mounting blocks 162,164 project from the base part 161 upon which can be mounted second part 16*b* of the respective mounting bracket. Each mounting block 162,164 includes substantially vertically arranged sides having serrated or tooth like formations 170 formed thereon. Mounting apertures 144 are provided in each mounting block 162,164 through which screws or nails can be inserted to secure the mounting brackets to the sides of the window opening. The second part 16*b* of each mounting bracket includes substantially rectangular recesses 166,168 for receiving the mounting blocks 162,164 of the first part 16*a* of the respective mounting bracket. The sides of the recesses 166,168 are provided with serrated or tooth like formations 172 adapted to engage the corresponding formations on the sides of the mounting blocks 162,164. As can be seen from FIGS. 7 to 10, the height of the mounting blocks 162,164 of the first part 16*a* of each mounting bracket is less than the height of the cooperating recesses 166,168 of the respective second part 16*b* so that the second part 16*b* of each mounting bracket can be mounted on the respective first part 16*a* in a number of different vertically spaced locations. The cooperating serrated or toothed formations 170,172 on the sides of the mounting blocks 162,164 and recesses 166,168 secure the two parts 16*a*,16*b* in the selected position. As shown in the drawings, calibrated markings may be provided on the mounting blocks 162,164 to enable the second part 16*b* of each mounting bracket to be mounted on the respective first part 16*a* in the desired position to ensure that the support beam 4 is mounted perpendicular to the sides of the window opening. The relative vertical location of the second part 16*b* or each bracket with respect to the respect first part can be adjusted within the limits of the difference in vertical height between the mounting blocks 162,164 and the recesses 166,168 within which the mounting blocks 162,164 are received.

Figure 3:
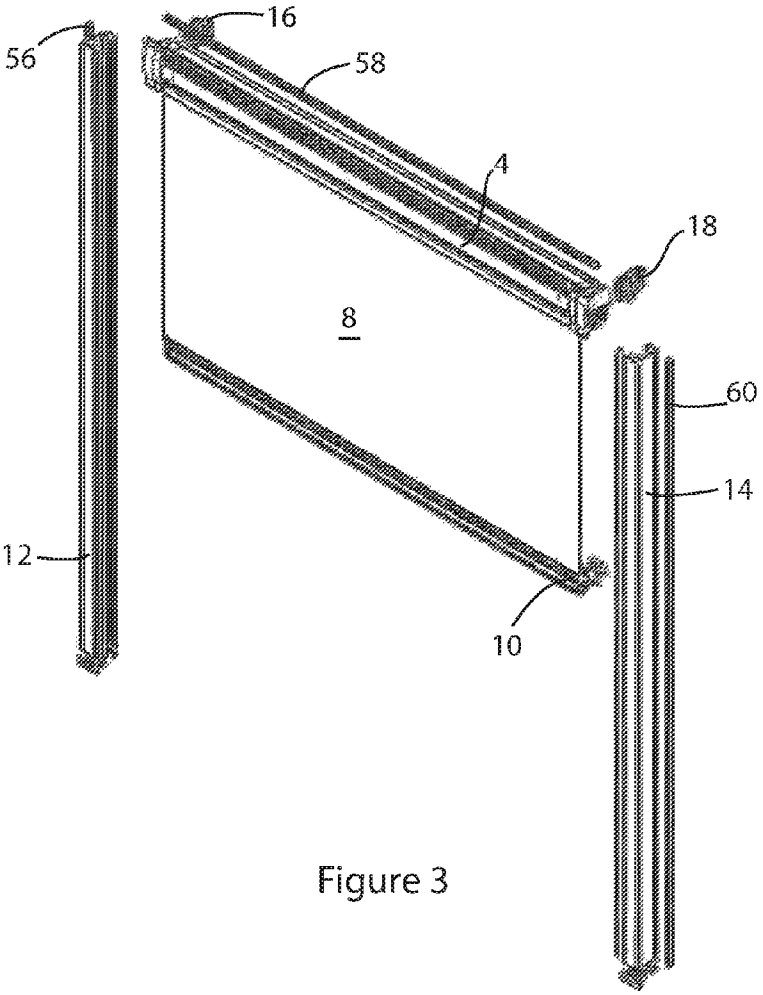
FIG. 3 is an exploded view of the screen assembly of FIG. 1.

As shown in FIG. 3, elongate resilient seals 56,58,60 are provided between the guide tracks 12,14 and the sides of the window opening and between the support beam 4 and the head or upper face of the window opening to prevent any leakage of light between the screen assembly and the widow opening and to provide a draft proof seal between the screen assembly and the sides of the window opening.

Figure 15:
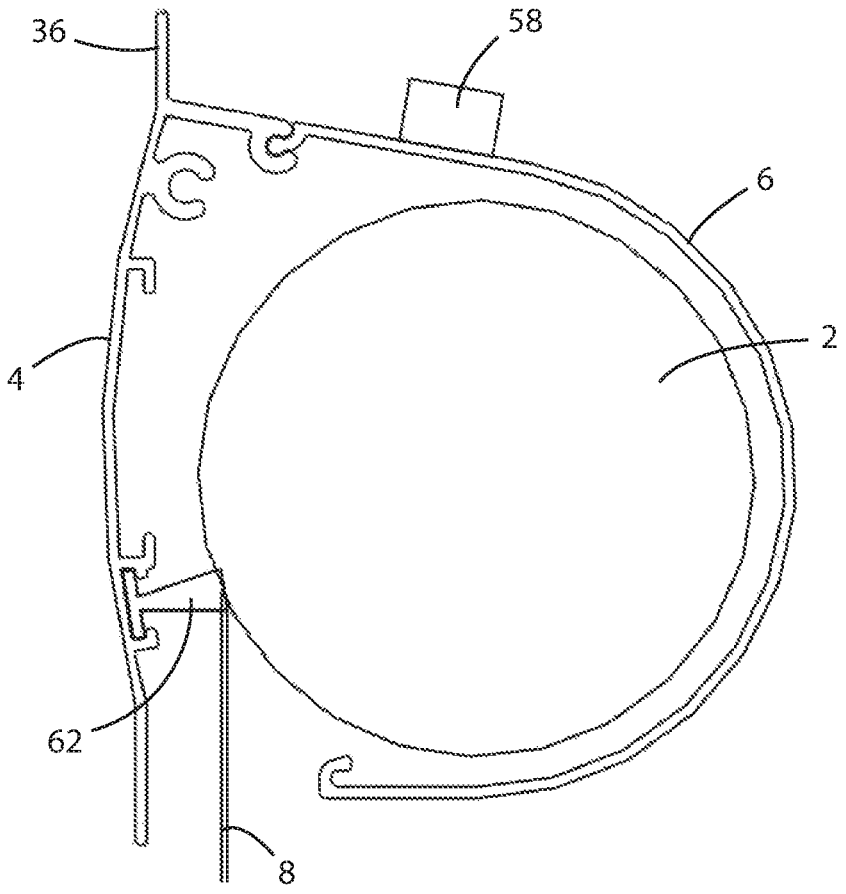
FIG. 15 is a sectional view through an upper part or cassette of the screen assembly of FIG. 1.

As cam be seen from FIG. 15, the support beam 4 comprises a hollow cassette 6 having an opening through which the screen 8 extends. The roller is journalled in either end of the cassette 6 to be rotatably mounted therein. One or more springs may be provided for biasing the roller in a winding direction to bias the screen to a fully open or raised position. An elongate brush like seal 62 is mounted on an inner face of the cassette 6 to engage the roller 2 to prevent the transmission of light through the cassette 6 and to prevent drafts. The support beam may be formed from an extrusion, preferably an aluminium extrusion.

Figure 16:
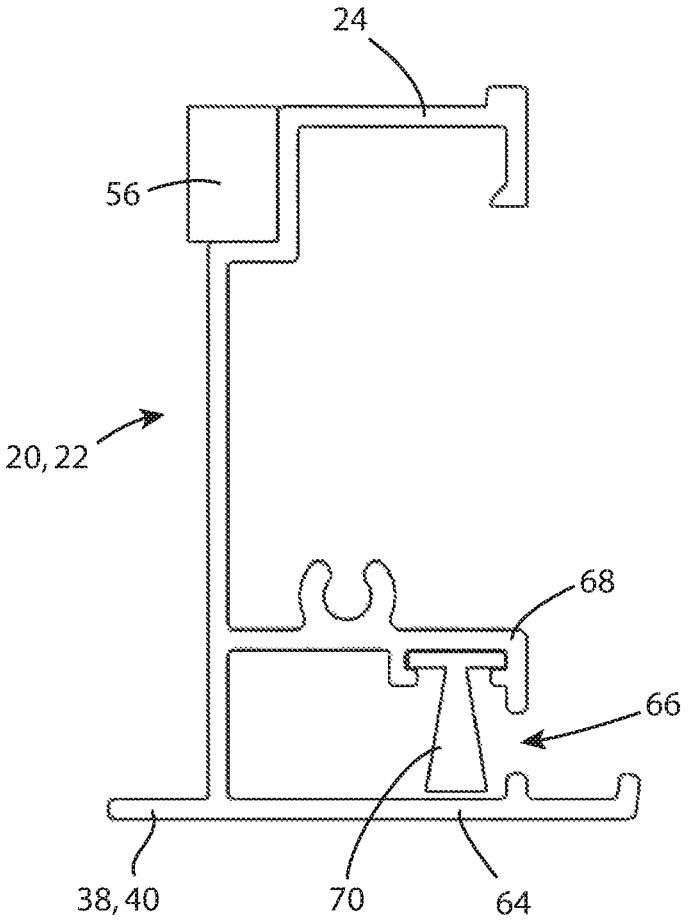
FIG. 16 is a sectional view through a guide track of the screen assembly of FIG. 1.
Figure 17:
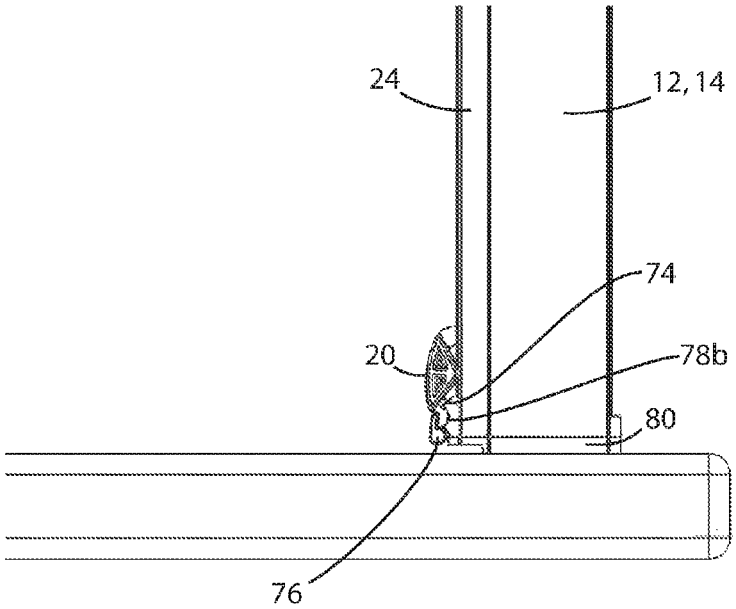
FIGS. 17 and 19 are a detailed side views of the handle and the positive locking device of the screen assembly of FIG. 1 in a locked lowermost position.
Figure 18:
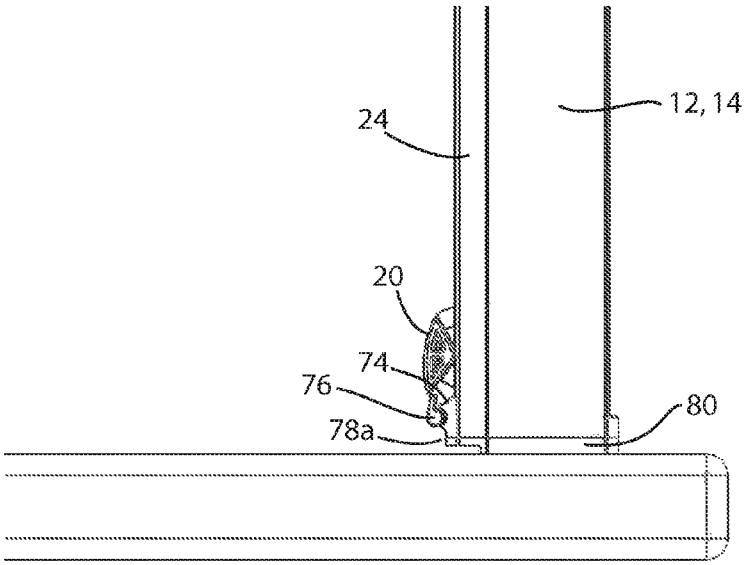
FIGS. 18 and 20 are a detailed side views of the handle and the positive locking device of the screen assembly of FIG. 1 in a locked intermediate position.
Figure 19:
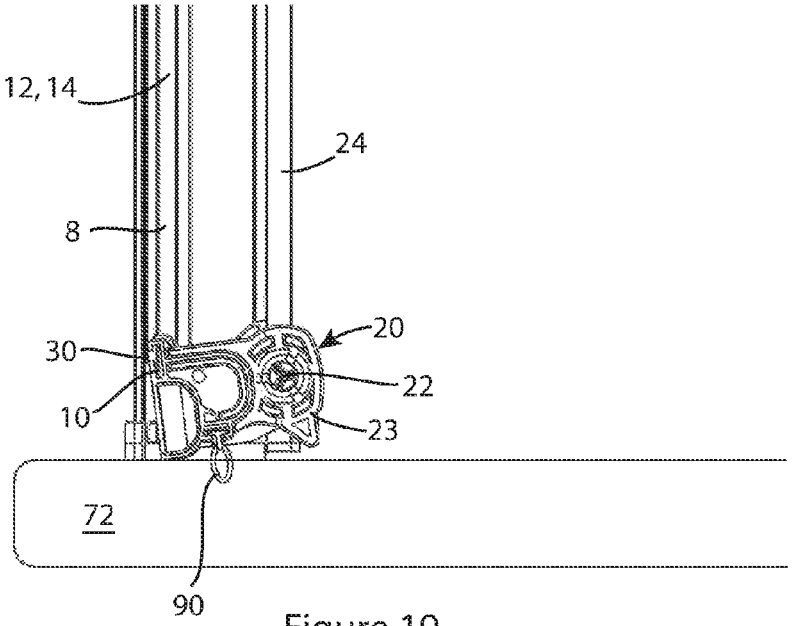
Figure 20:
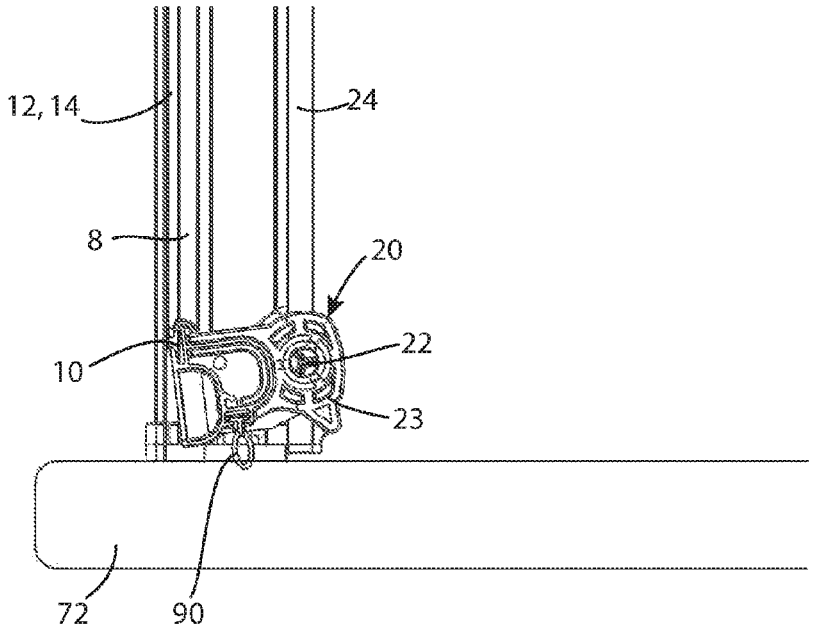
Figure 21:
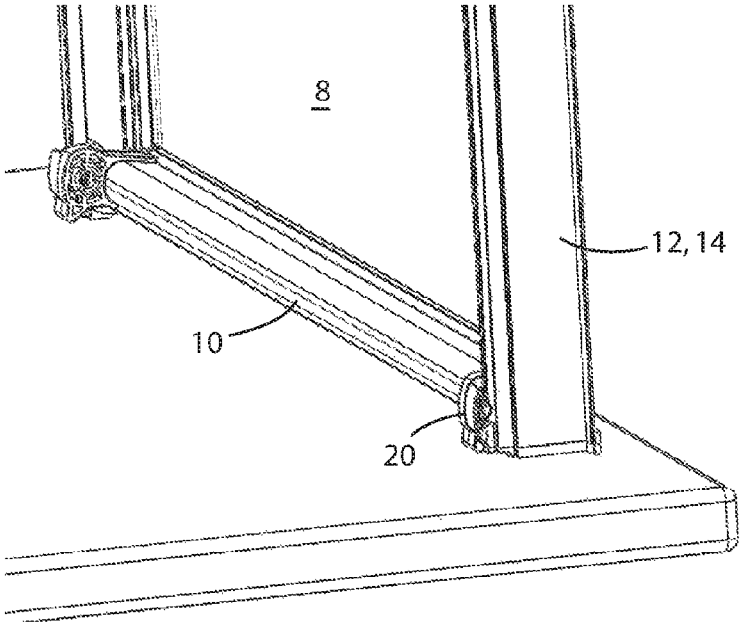
FIGS. 21 and 22 are a perspective views of the positive locking device of the screen assembly of FIG. 1 in its locked lowermost position.
Figure 22:
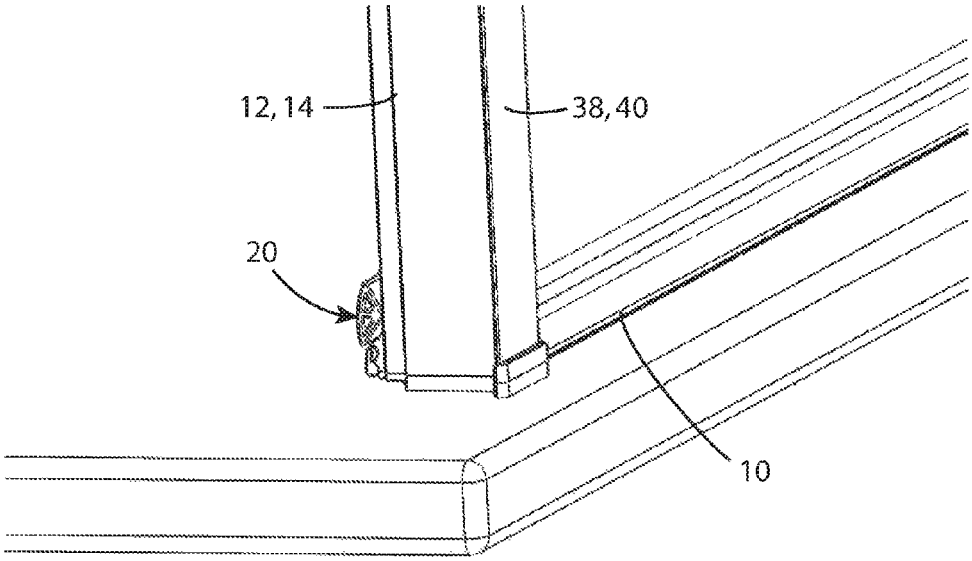
Figure 23:
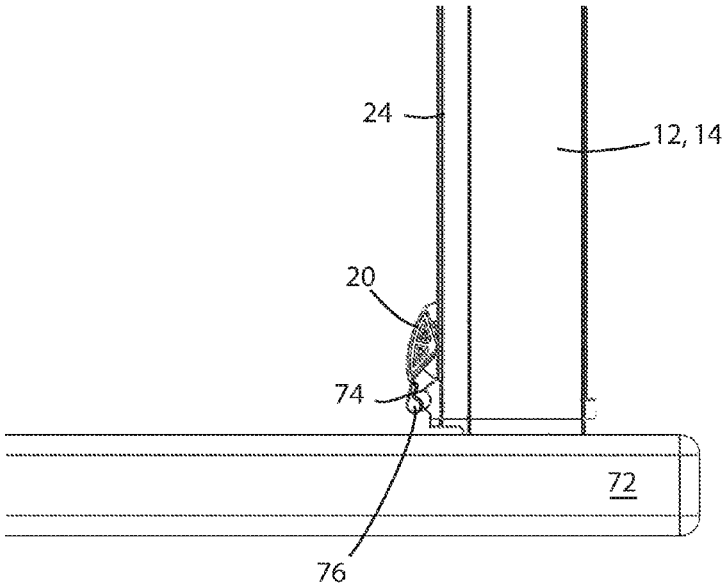
FIGS. 23 and 24 are detailed side views of the handle and the positive locking device of screen assembly of FIG. 1 in its unlocked position.
Figure 24:
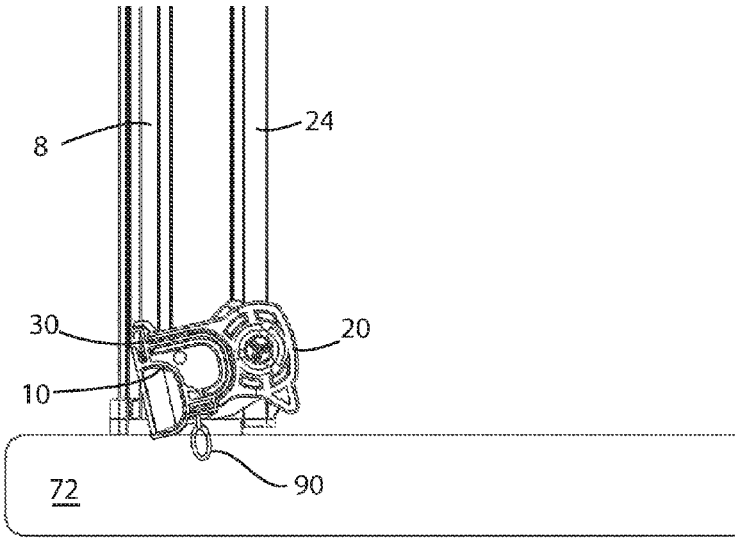
Figure 25:
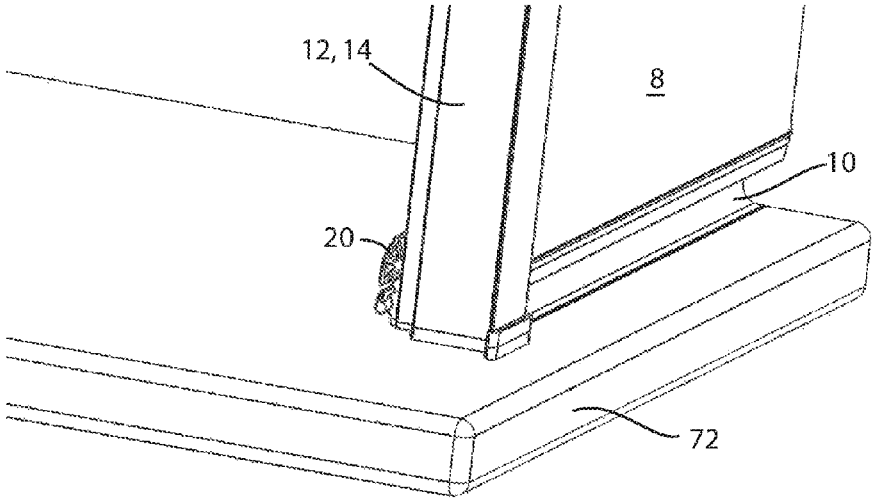
FIGS. 25 and 26 are detailed perspective views of the screen assembly of FIG. 1 showing the positive locking device in its unlocked position.
Figure 26:
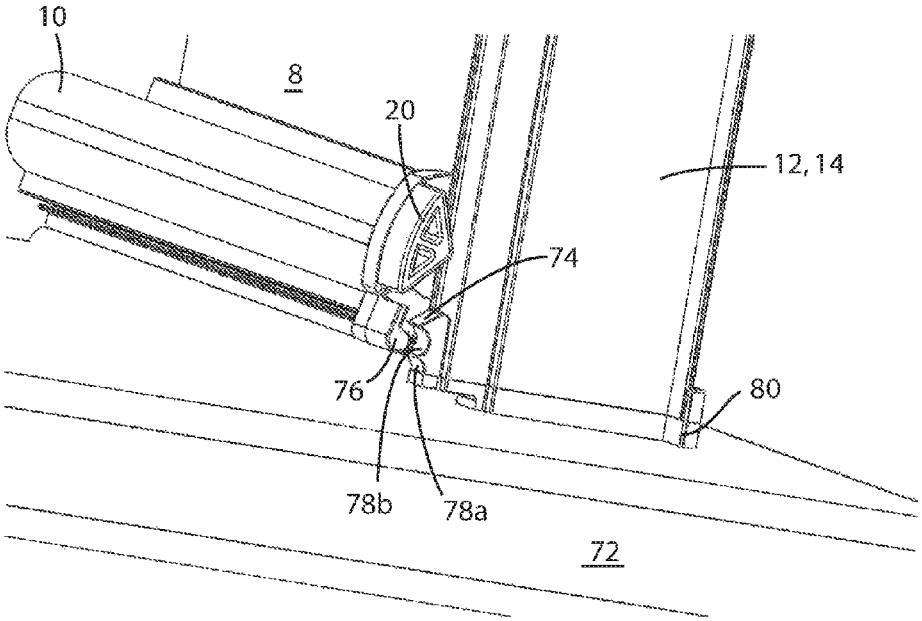

As shown in FIG. 16, each guide track 12,14 comprises an elongate extrusion, preferably formed from aluminium, defining an outer wall 64 with integrally formed contiguous flange 38,40, for overlapping the wall adjacent the sides of the window opening. An inner flange 68 extends parallel to the outer wall 64 to define a channel 66 for receiving a side of the screen 8. A brush like seal 70 is mounted on the flange 68 to engage a rear face of the screen 8 to form a draft proof and light proof seal against the screen 8.

The ends of the handle 10 are provided with respective locking devices 20 adapted to engage either side of vertically extending rail 24 defined by a rear wall of the guide tracks 12,14 to lock the screen 8 in any desired position against the restoring force of the tensioned roller 2.

Figure 14:
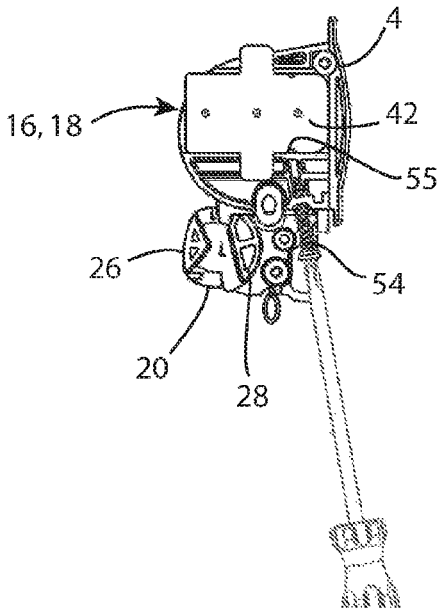

As shown in FIG. 14, the locking devices 20 each comprise first and second parts 26,28 located on opposite sides of the elongate rail 24 of the respective guide track 12,14 such that rotation of the respective locking device 20 brings said first and second parts 26,28 thereof into engagement with either side of the rail 24 to grip the rail 24.

As can be seen from FIGS. 17 to 26, the locking devices 20 are rotatable about an axis extending transversely to the screen 8 between a locking position, wherein the first and second parts 26,28 of the locking devices 20 engage the respective rail 24 of the guide tracks 12,14 to prevent movement of the screen 8, and an unlocked position, wherein the screen 8 is free to move, the locking devices 20 being rotatable to their locking positions under the tension applied by the tensioned roller 2 on the screen 8 and being rotated to their unlocked position by a force applied to the handle 10 against the tension applied by the tensioned roller 2. The handle 10 is provided with an elongate channel 30 for receiving the end of the screen 8 such that the tensioned screen 8 acts on the handle 10 to pivot the handle 10 about a fulcrum defined by the pivot axis of the locking devices 20 whereby the tensioned screen 8 pulls on the handle 10 to rotate the locking devices 20 towards their respective locking positions against the respective rail 24.

Each locking device 20 (which are symmetrically provided on either end of the handle 10 and are mirror images of each other) comprises a base part 22 mountable on a respective end of the handle 10 and a locking part 23 mounted on the base part 22 for limited rotational movement with respect to the base part 22 about the rotatable axis of the locking devices 20.

Each locking device 20 is provided with a positive locking device for locking the screen 8 in a fully closed position with the handle 10 engaging the sill 72 of the window. Each positive locking device comprises at least one ramped projection or latch 74 provided on a rear face of a lower end of a respective rail 24 of the respective guide track 12,14 preferably on a moulding mounted on the bottom of each rail 24 and a cooperating pawl 76 mounted on the locking part of the respective locking device 20. The pawl 76 is movable between a release position, wherein the pawl 76 can move past the latch 74 of the rail 24, and a locked position, wherein the pawl 76 is located in a seat behind the ramped latch 74 of the rail 24 to lock the screen in a closed position. The pawl 76 is biased towards its locked position under the action of the tensioned screen. The ramped upper face of each latch 74 assists movement of the respective pawl 76 past the latch 74 into its seat as the screen is closed and the handle 10 is brought into contact with the window sill.

In the embodiment shown in FIGS. 17 to 26, the foot of each rail is provided with a moulded end fitting 80 having a pair of vertically spaced latch seats 74*a*,74*b*, providing two vertically spaced seats for receiving the pawl 76 of the respective locking device 20, a lowermost seat 78*a* for securing the screen 8 in a locked lower position, shown in 18 and 20, and an intermediate seat 78*b*, above the lowermost seat 78*a*, for securing the screen 8 in a locked intermediate position. End fittings 80 having different thicknesses, and or additional shims, may be provided for adjusting the gap between each guide track 12,14 and the sill 72 to take account of tolerance variations in the shape and dimensions of the window opening.

The screen 8 can be closed by pulling the handle 10 downwardly. As the handle 10 reaches is lowermost position in engagement with the sill 72, the pawls 76 move past the latches 74 provided on the guide tracks 12,14, over the ramped upper faces of the latches 74. Upon release of the handle 10, the tension of the screen 8 on the handle 10 rotates the locking devices 20 to their locking positions, causing the pawls 76 to engage behind the latches 74 to lock the screen in its fully closed position, as shown in FIGS. 17 to 26. When the screen 8 is to be opened the handle is pulled down, rotating the locking devices 20 to move the pawls 76 to their release position to release the pawls 76 from the latches 74 to enable the handle 10 to be raised to open the screen 8.

A resilient seal 90 is provided on a lower face of the handle 10, the seal 90 being adapted to engage the sill to shut out draft and any light transmission between the sill 72 and the handle 10 when the screen is fully closed.

The invention is not limited to the embodiment(s) described herein but can be amended or modified without departing from the scope of the present invention.

The invention claimed is:

1. A screen assembly for a window comprising a screen supported by an elongate support member adapted to be mounted in an upper region of the window opening, a pair of mounting brackets being provided for attachment to respective sides of the window opening adjacent the top face of the window opening, each end of the elongate support member having an engaging device for engaging a respective mounting bracket, whereby the mounting brackets may be attached to the sides of the window opening such that the support member may be engaged onto the mounting brackets to mount the support member in the window opening, wherein each mounting bracket comprises a first part attachable to a respective side of the window opening and a second part adapted to be mounted on the first part, said second part being configured to engage a respective end of the elongate support member, wherein each second part of each mounting bracket includes at least one recess for receiving at least a portion of the first part of the respective mounting bracket, the recess defined by opposed perimeter sides, the perimeter sides of the recess being provided with vertically spaced formations configured to engage corresponding vertically spaced formations on laterally opposed sides of the first part, wherein said second part can be vertically adjusted on the respective first part in a plurality of vertically spaced positions to enable the relative position of the second part of each mounting bracket to be vertically adjusted on the first part, in use, in a substantially vertical direction.

2. A screen assembly as claimed in claim 1, wherein the elongate support member is provided with a flange adapted to be located against an outer face of the window opening to obscure any gap existing between the support member and the window opening.

3. A screen assembly as claimed in claim 2, wherein said flange extends along an upper side of the elongate support member to obscure any gap between the upper side of the elongate support member and the upper side of the window opening.

4. A screen assembly as claimed in claim 3, wherein said flange is substantially contiguous with a front face of the elongate support member.

5. A screen assembly as claimed in claim 1, wherein said engaging device on each end of the elongate support member comprises a recess for receiving a body portion of a respective bracket such that the elongate support member may be engaged over the mounting brackets to retain the support member between the sides of the window opening.

6. A screen assembly as claimed in claim 1, wherein the elongate support member is secured on the mounting brackets by the insertion of a fastening device through support member into the respective bracket.

7. A screen assembly as claimed in claim 6, wherein said fastening device comprises a screw or nail.

8. A screen assembly as claimed in claim 6, wherein said fastening device is inserted through mounting apertures provided in a lower face of the support member.

9. A screen assembly as claimed in claim 6, wherein a receiving aperture may be formed in each side of the support member for guiding the fastening device into the respective bracket.

10. A screen assembly as claimed in claim 9, wherein the receiving aperture is inclined to the vertical to assist insertion of the respective fastening device.

11. A screen assembly as claimed in claim 1, wherein the screen comprises a plurality of vertically or horizontally spaced louvres, vanes or planar strips.

12. A screen assembly as claimed in claim 1, wherein the screen comprises a roller blind defined by a sheet of fabric or similar flexible material wound onto a roller, said roller being mounted on or within said elongate support member.

13. A screen assembly as claimed in claim 12, wherein the roller is tensioned to bias the roller in a winding direction whereby a biasing force is applied to the screen towards a raised or open position.

14. A screen assembly as claimed in claim 13, wherein the screen is moveable between a pair of spaced guide tracks adapted to be mounted on each side of the window opening, a handle assembly being mounted on a free end of the screen between said guide tracks.

15. A screen assembly as claimed in claim 14, wherein each guide track is provided with a flange defining an extension of a front face of the guide track to extend over an outer face of the window opening to close any gap between the sides of the window opening and the guide tracks.

16. A screen assembly as claimed in claim 15, wherein said flange is substantially contiguous with the front face of the guide track.

17. A screen assembly as claimed in claim 15, wherein the flange is integral with the front face of the guide track.

18. A screen assembly as claimed in claim 14, wherein a resilient sealing device is provided between abutting faces of the elongate support member and the window opening and between the guide tracks and the support member.

19. A screen assembly as claimed in claim 18, wherein said resilient sealing device comprises an elongate strip of resilient material.

20. A screen assembly as claimed in claim 14, wherein foam strips, fiber brushes or other sealing device are mounted on an inner face of each guide track to create a draft and light-proof seal against a face of the screen.

21. A screen assembly as claimed in claim 20, wherein foam strips, fiber brushes or other sealing devices are provided between an inner face of the support member and the roller.

22. A screen assembly as claimed in claim 14, wherein a locking device is mounted on each end of the handle assembly, each locking device being moveable between a locking position, wherein the locking device engages a respective one of the guide tracks to prevent movement of the screen, and an unlocked position, wherein the screen is free to move with respect to the guide tracks, said locking devices being biased towards their locked positions by said biasing force of the screen on the handle and being moveable towards their unlocked position, against said biasing force of the tensioned screen, by operation of the handle assembly.

23. A screen assembly as claimed in claim 22, wherein a resilient seal is provided on a lower side of the handle to engage the sill when the screen is in a fully closed position.

24. A screen assembly as claimed in claim 22, wherein each locking device is connected to a respective end of the handle assembly by a connection device permitting limited movement of the respective locking device with respect to the handle assembly to accommodate misalignment between the locking devices and the guide tracks.

25. A screen assembly as claimed in claim 24, wherein said locking devices are rotatable between their respective locking and unlocked positions about a rotational axis extending transversely of the screen, each respective connection device being adapted to permit limited rotational movement of the respective locking device with respect to the handle.

26. A screen assembly as claimed in claim 25, wherein each guide track comprises an elongate rail, each locking device comprises first and second parts located opposite sides of the rail such that rotation of the locking device brings said first and second parts of the locking device into engagement with either side of the rail to grip the rail.

27. A screen assembly as claimed in claim 25, wherein each guide track comprises a pair of parallel rails, each locking device being located between the parallel rails of a respective guide track, each locking device having an elliptical or elongated shape having a length greater than the width of the track.

28. A screen assembly as claimed in claim 25, wherein the handle assembly is mounted for pivotal movement about said rotational axis of the locking devices with respect to the guide tracks between a first position wherein the locking devices are in their locking positions and a second position wherein the locking devices are in their unlocked position, the handle being arranged such that the handle is pivoted towards its first position under the action of the tensioned screen whereby the locking devices engage the guide tracks to automatically lock the screen in a desired position when the handle is released by a user.

29. A screen assembly as claimed in claim 28, wherein the guide tracks are provided with a positive locking device to positively lock the screen in a fully closed position.

30. A screen assembly as claimed in claim 29, wherein the positive locking device comprises a projection, a catch, a pawl or a seat provided on each guide track, each locking device of the handle having a corresponding at least one projection, catch, pawl or seat arranged to engage or receive the respective projection, catch, pawl or seat of the respective guide track to positively lock the screen in its lowermost fully closed position.

31. A screen assembly as claimed in claim 30, wherein the positive locking device is arranged such that each projection, catch pawl or seat of the handle is biased into engagement with the at least one respective corresponding projection, catch, pawl or seat of the guide track as the handle is pivoted towards its first position under the action of the tensioned screen.

32. A screen assembly as claimed in claim 31, wherein the positive locking device comprises at least one ramped latch provided on a face of each guide track and a cooperating pawl provided on each locking device of the handle for engaging the latch to lock the screen in a substantially fully closed or lowered position.

33. A screen assembly as claimed in claim 32, wherein the handle engages the sill of the window opening when said screen is in its substantially fully closed or lowered position.

34. A screen assembly as claimed in claim 1, wherein each mounting bracket is provided with a laterally extending tab or wing extending from the upper side of the mounting bracket to enable the spacing between the mounting bracket and the upper face of the window opening to be set by abutting the tab or wing against the upper face of the window opening.

35. A screen assembly as claimed in claim 1, wherein each mounting bracket is securable to a respective side of the window opening by means of one or more nails or similar fasteners or by means of an adhesive.

36. A screen assembly as claimed in claim 35, wherein one or more apertures are provided in each mounting bracket for receiving said fasteners.

37. A screen assembly as claimed in claim 1, wherein the first part of each mounting bracket comprises a planar base part having an upper tab or wing arranged to abut an upper corner of the window opening to locate the first part of each mounting bracket against the window opening, at least one substantially rectangular mounting block projecting from the base part, wherein said recess of each second part of each mounting bracket comprises a substantially rectangular recess for receiving the respective mounting block of the first part of the respective mounting bracket, the formations on the perimeter sides comprising vertically spaced serrated or tooth formations configured to engage the corresponding vertically spaced formations of the first part, which are located on the sides of the mounting block, and wherein the height of the mounting block of the first part of each mounting bracket is less than the height of the cooperating recess of the respective second part so that the second part of each mounting bracket can be vertically adjusted in the respective first part in a number of different vertically spaced locations.

38. A screen assembly as claimed in claim 37, wherein the first part of each mounting bracket comprises a pair of the mounting blocks, the second part of each mounting bracket comprising a pair of the recesses for receiving the respective mounting blocks of the first part.

39. A screen assembly as claimed in claim 37 wherein mounting apertures are provided in the first part of each mounting bracket through which screws or nails can be inserted to secure the mounting brackets to the sides of the window opening.

* * * * *